US007315130B1

(12) United States Patent
Chen et al.

(10) Patent No.: US 7,315,130 B1
(45) Date of Patent: Jan. 1, 2008

(54) SWITCHING CONTROL FOR INVERTER STARTUP AND SHUTDOWN

(75) Inventors: Timothy Chen, Aurora, OH (US); James K. Skully, Willoughby, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/645,939

(22) Filed: Dec. 27, 2006

(51) Int. Cl.
*H05B 37/00* (2006.01)

(52) U.S. Cl. ..... 315/127; 315/119; 315/225; 315/240; 315/209 R; 315/224; 315/238; 315/278; 363/18; 363/98; 363/56.05; 363/50

(58) Field of Classification Search ..... 315/119, 315/127, 128, 225, 244–247, 224, 238, 278, 315/308, DIG. 5, DIG. 7; 363/17, 18, 131, 363/132, 50, 98, 56.01, 56.02, 56.05, 21.02, 363/21.07
See application file for complete search history.

(56) References Cited

U.S. PATENT DOCUMENTS 4,503,363 A * 3/1985 Nilssen ..... 315/225
4,507,698 A * 3/1985 Nilssen ..... 361/42
4,896,079 A 1/1990 Tabor
5,327,048 A * 7/1994 Troy ..... 315/240
5,475,284 A * 12/1995 Lester et al. ..... 315/209 R
5,770,925 A * 6/1998 Konopka et al. ..... 315/225
6,127,786 A 10/2000 Moisin
6,137,233 A 10/2000 Moisin
6,204,614 B1 3/2001 Erhardt
6,222,326 B1 4/2001 Moisin
6,507,157 B1 1/2003 Erhardt et al.
6,819,057 B2 * 11/2004 Alexandrov ..... 315/209 R

* cited by examiner

*Primary Examiner*—Haissa Philogene
(74) *Attorney, Agent, or Firm*—Fay Sharpe LLP

(57) ABSTRACT

An electronic ballast circuit for a lamp is described, wherein the ballast comprises a power factor correction circuit coupled to an inverter circuit. The inverter circuit is further coupled to a trigger circuit, which is in turn operatively connected to a hot or neutral line of a power supply by a control line. Upon closing a switch in the control line, the trigger circuit operates to place a capacitor in parallel with a base drive winding of a transistor in the inverter circuit, causing the inverter circuit to shut down. When the switch is opened, the trigger circuit shuts off and the inverter starts up and returns to an oscillating state.

20 Claims, 5 Drawing Sheets

SWITCHING CONTROL FOR INVERTER STARTUP AND SHUTDOWN

BACKGROUND OF THE INVENTION

Aspects described herein relate generally to lighting devices, and more particularly to ballast circuitry for discharge lamps.

When designing lamps and associated circuitry, economic considerations are of paramount importance and often mean the difference between an acceptable design and an optimal design. Often, one or more of lamp size, manufacture cost, and/or energy efficiency dictate a majority of parameters associated with a given lamp design. Modern lamps come in a variety of sizes to accommodate multiple design variations. For instance, a T8 lamp size is approximately one inch in diameter, while a T12 lamp is approximately one and a half inches in diameter. Other sizes are also available to meet designer and consumer needs.

A gas discharge lamp is one example of what is known as a "negative resistance" device, which is a device that is capable of drawing an increasing amount of current until it either burns out the power source or itself. Often, such discharge lamps employ a ballast to control an amount of current flowing through a lamp circuit. A ballast may be as simple as resistor in series with a lamp, such as is utilized for the relatively low-powered neon lamp. More complex ballasts may be utilized for higher power applications, and may comprise resonant components such as capacitor and inductors. Typically, a reactive ballast is more efficient than a simple resistor.

Electronic ballasts utilize electronic circuitry to stabilize current for fluorescent lamps, high-intensity discharge lamps, and the like. Electronic ballasts may be started using one of several starting techniques, including "instant" start, "rapid" start, and "programmed" start. The instant start starts a lamp in the short term, because it starts and operates the ballast without preheating a cathode associated therewith, which results in low energy cost to start but wears out the lamp more rapidly than other starting protocols due to the violent nature of the starting method. The rapid starting technique starts the ballast and heats the cathode concurrently, resulting in a relatively long start time while mitigating the deleterious effects of a cold start on the lamp's cathode. Finally, the programmed start technique employs a cathode preheating period at low glow discharge current which increases the lamp's life for frequency switching applications.

With regard to energy efficiency, a lamp and/or ballast may be designed to minimize power losses as well as to effectively minimize power consumed by the lamp and/or ballast. In the case of manufacturing cost, it may be desirable to minimize a number of circuit components needed to perform a given function, as well as to design circuits such that perform a given function using a number of least-expensive parts and to avoid costly components such as integrated circuits and the like. With respect to ballast size, it may be desirable to design a circuit that occupies as little space as possible to perform the given function in order to facilitate utilization of the ballast in applications where space conservation is an issue. There is an unmet need in the art for systems and/or methods that facilitate overcoming deficiencies associated with the foregoing.

BRIEF DESCRIPTION OF THE INVENTION

According to one or more aspects, a system that facilitates automated shutdown and restart of a ballast circuit for a lamp comprises a capacitor positioned in a parallel orientation to a base drive winding for a first transistor in an inverter circuit, a control line coupled to a voltage source that supplies a voltage to the ballast, and a switch in the control line that is manipulated to concurrently disable inverter oscillation and supply voltage to a trigger circuit coupled to the inverter.

According to other aspects, a method of automatically shutting down and restarting a ballast circuit for a lamp comprises employing a capacitor in parallel with a base drive winding for a bipolar junction transistor (BJT) in an inverter circuit, employing a control line with a switch from a voltage source to a trigger circuit coupled to the inverter circuit, and selectively closing the switch to supply a voltage to the trigger circuit and shut down the inverter circuit.

According to other features, a system that facilitates selectively shutting down and restarting an inverter in a ballast circuit for a lamp comprises means for providing a control signal to a trigger circuit coupled to an inverter in the ballast circuit, means for placing a capacitor in parallel with a base drive winding of a transistor in the inverter to shut down the inverter when a switch in the control line is closed, and means for placing the inverter in an oscillatory state when the switch is open.

DETAILED DESCRIPTION OF THE INVENTION

In accordance with various aspects and features described herein, systems and methods are presented that facilitate reducing energy consumption by a lighting system. Such aspects and features may comprise reducing load power consumption by, for example, turning off one or more lamps associated with a given lamp ballast circuit and/or dimming a given lamp's power level to reduce power consumption. To achieve these goals, a control point may be inserted into a lamp ballast circuit, such as by connecting a switch to a hot or neutral power line.

An electronic ballast is described herein that facilitates performing a shutdown-startup protocol for the ballast and/or associated lamps. For example, the electronic ballast may be a trigger-start self-oscillating electronic ballast, and may be controlled using a few passive components and an active switcher without integrated circuits, if desired, even if the device to be controlled is a floating gate device. By placing a start up capacitor in parallel with a base drive winding in the circuit, inverter oscillation and the trigger circuit may be concurrently controlled. Accordingly, repetitive triggering may be mitigated after the ballast is shut down. In addition, a similar and/or identical control technique can be used for an end of lamp's life (EOL) protection circuit.

Bi-level control has become popular for high-intensity discharge (HID) lamp systems due to its simplicity and cost-efficiency. This control has also gained popularity for fluorescent discharge lighting systems with electronic ballasts due to high energy savings at low cost. According to various features, a current-fed self-oscillating program start ballast is described, such as may be utilized in a T5 lamp application, and is designed in a manner that mitigates problems associated with conventional integrated circuit (IC) controlled ballasts, which tend to be expensive. Additionally, IC driven ballasts tend to be less robust to operating conditions of the lighting system, and are therefore subject to higher failure rates that non-IC driven ballasts. In some systems, when a connection is made from a switching line to a neutral line, a signal is fed to a ballast control IC. The ballast responds to the signal by disabling the output of the control IC which, in turn, shuts down the lamps that are controlled by the IC.

Figure 1:
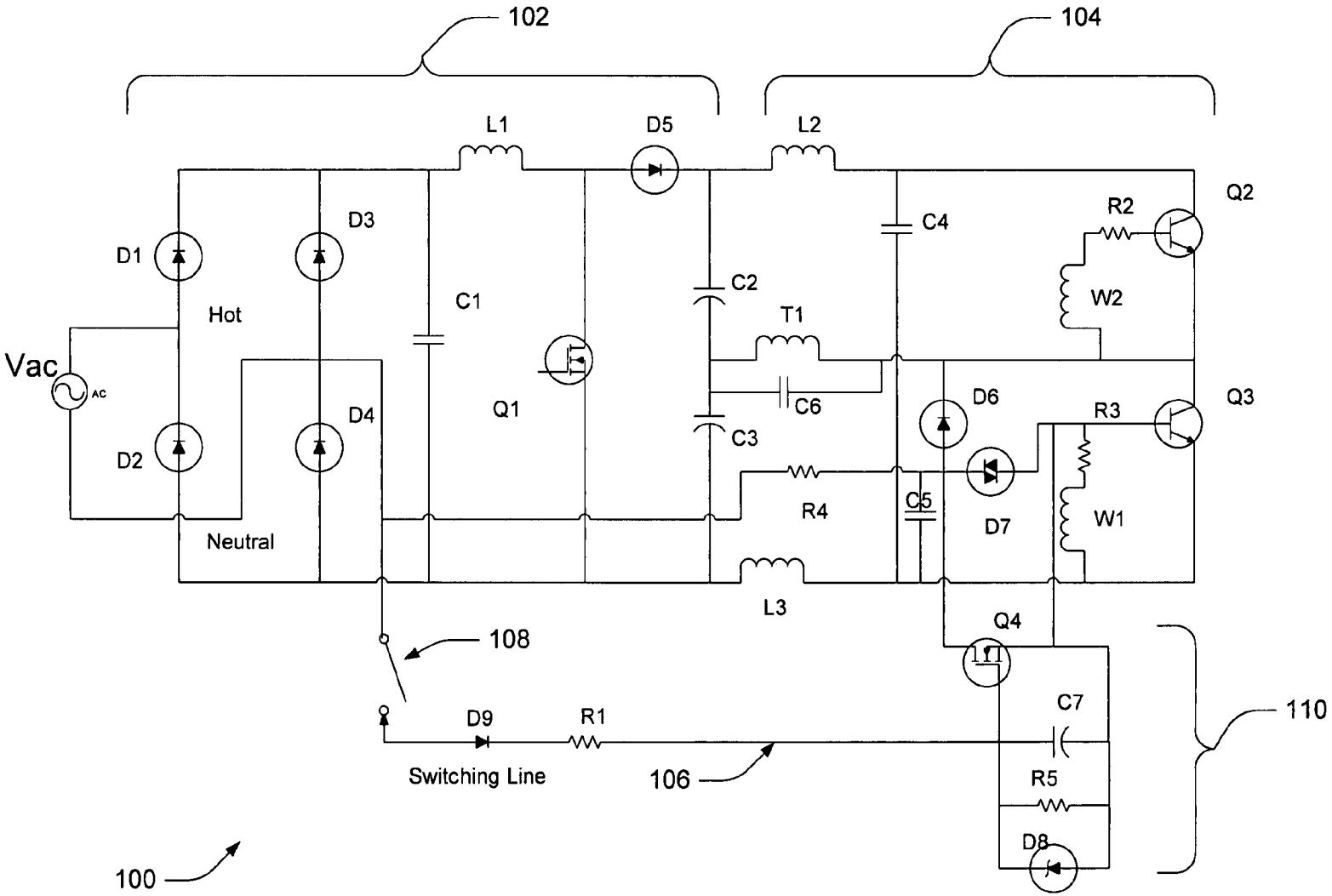
FIG. 1 illustrates a schematic diagram of a ballast topography, wherein the ballast permits bi-level control for a lighting system by providing a line control step-level switching mechanism for the ballast.

With reference to FIG. 1, a schematic diagram of a ballast topography 100 is illustrated, wherein the ballast permits bi-level control for a lighting system by providing a line control step-level switching mechanism for the ballast 100. For instance, in a scenario in which it is desirable to turn off a lamp for energy savings, such as in a room in which no occupants are present, ballast 100 may facilitate lamp shut-off. The ballast 100 may be utilized in conjunction with a T5 discharge lamp, as well as other size discharge lamps, including but not limited to T8, T4, T3, T2, or any other size lamp in which line control step-level switching is desired. The ballast 100 comprises an input and power factor control (PFC) portion 102 comprising a first set of components, and an inverter portion 104. The input-PFC portion 102 includes a full-bridge rectifier (D1-D4), inductor L1, diode D5, capacitors C1, C2, C3, and switch Q1. The inverter portion 104 includes switching portions (Q2, R2, W2) and (Q3, R3, and W1), as well as capacitors C4, C5, C6, inductors L2, L3, diode D6, diac D7, resistor R4, and winding T1.

The PFC 102 and inverter 104 are coupled by a switching line 106 that facilitates triggering a shutdown/restart mechanism in accordance with various aspects. For instance, a switch 108 in switching line 106 may be triggered by a remote sensor (not shown), such as a motion sensor or the like, which detects a presence or absence of an occupant in an area that is illuminated by one or more lamps associated with ballast 100. When the motion sensor is activated, the switch 108 may be in an open state to permit the ballast to operate normally. When the motion sensor is not activated (e.g., when no occupants are detected), the switch 108 may be triggered to close, resulting in an initiation of the aforementioned events.

For instance, upon applying input power to the ballast 100, capacitor C5 is charged up by resistor R4. When a voltage across C5 reaches a breakdown voltage of diac D7, a high di/dt current is applied to the base drive winding W1 to initiate inverter oscillation. A diode D6 discharges the capacitor C5 when Q3 is on. In accordance with various aspects, Q3 may be a bipolar junction transistor (BJT). A low-voltage MOSFET Q4 is connected in parallel with diac D7. Zener diode D8, resistor R5 and capacitor C7 are in parallel and connected from gate to source of Q4. A resistor R1 is connected to one end of the switching line 106, and the other end of the switching line 106 is connected either to a "Neutral" or a "Hot" input line.

When the switch 108 in the switching line 106 is in an "off" position (e.g., the switch 108 is open), there is no voltage developed across the Q4 gate-to-source of a trigger circuit 110. Therefore, the Q4 switch is the off position, and the current-fed inverter 104 is in a normal operating condition. When the switching line 106 is on (or off in a case where reverse logic is utilized), the half-rectified input voltage will be scaled down and the averaged voltage is applied to the gate-to-source of the switch Q4. This voltage turns on Q4 and puts the capacitor C5 in parallel with winding W1 and resistor R3. The capacitor C5 effectively bypasses the base drive current away from Q3, and the inverter oscillation stops. At the same time, the switch Q4 prevents a voltage build up on the capacitor C5 from startup resistor R4. Upon opening the switch on the switching line 106, the Q4 gate-to-source voltage drops and Q4 turns off, and allow the C5 to charge by R4 at which point, the breakdown of the diode D7, the inverter restarts and ballast operation resumes.

Thus, upon applying power to the ballast 100 (e.g., turning on a light switch connected thereto), the PFC section 102 is operational. Current traversing the resistor R4 charges up capacitor C5. Once the voltage on capacitor C5 reaches a breakdown point of diac D7, the diac D7 breaks down and a high current (di/dt) is applied to the base of Q3, which turns on Q3. During a subsequent half-cycle of an applied voltage waveform, Q2 turns on and Q3 turns off. This sequence may repeat every half cycle with switches Q2 and Q3 alternating respective on and off states. Whenever switch Q3 turns on, capacitor C5 begins to discharge because D6 is conducting. However, when switch Q3 turns off the capacitor C5 is charging. Because the time constant associated with capacitor C5 is longer than the half-cycle period for which switch Q3 is in the off state, the voltage on C5 does not reach the breakdown voltage of the diac D7. By positioning capacitor C5 in parallel with the base drive winding W1 of Q3, current through the base of Q3 is reduced, thereby turning Q3 off and shutting down its portion of the circuit, and thus the ballast 100 shuts down as well.

Figure 2:
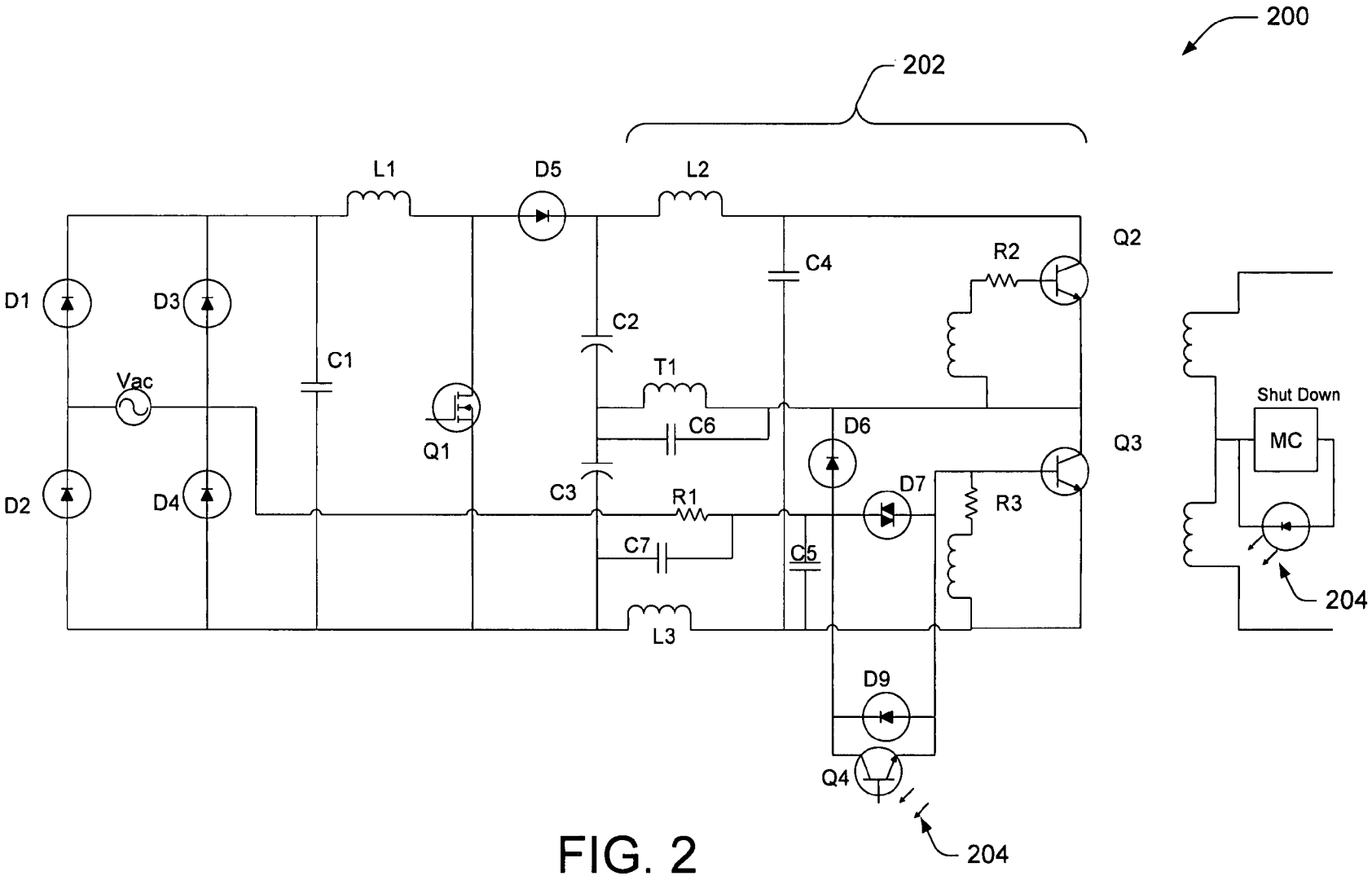
FIG. 2 is an illustration of a schematic diagram of a ballast topography, that shows an EOL shutdown protection circuit with an optocoupler for output isolation.

FIG. 2 is an illustration of a schematic diagram of a ballast 200 topography, which may be similar to the ballast topography 100 described above, and which shows an EOL shutdown protection circuit inverter 202 with an optocoupler 204 for output isolation. The ballast 200 represents an example of an end-of-lamp-life (EOL) protection circuit that may be utilized in conjunction with the various features described herein. When an EOL shutdown signal is applied to the input side of the optocoupler 204, the diac D7 is bypassed and the inverter 202 is shut down. Upon relamping, an EOL pin associated with a controller (MC) outputs a low signal (e.g., such as a binary 0 in terms of digital logic), the ballast restarts, and normal operation resumes. It will be noted that the capacitor C5 is oriented in the same parallel configuration described above with regard to FIG. 1, and functions similarly. Thus, by utilizing a capacitor such as capacitor C5, ballast 200 may be shut off and restarted as desired to mitigate re-triggering events that may overheat the ballast and/or lamp couplings.

Figure 3:
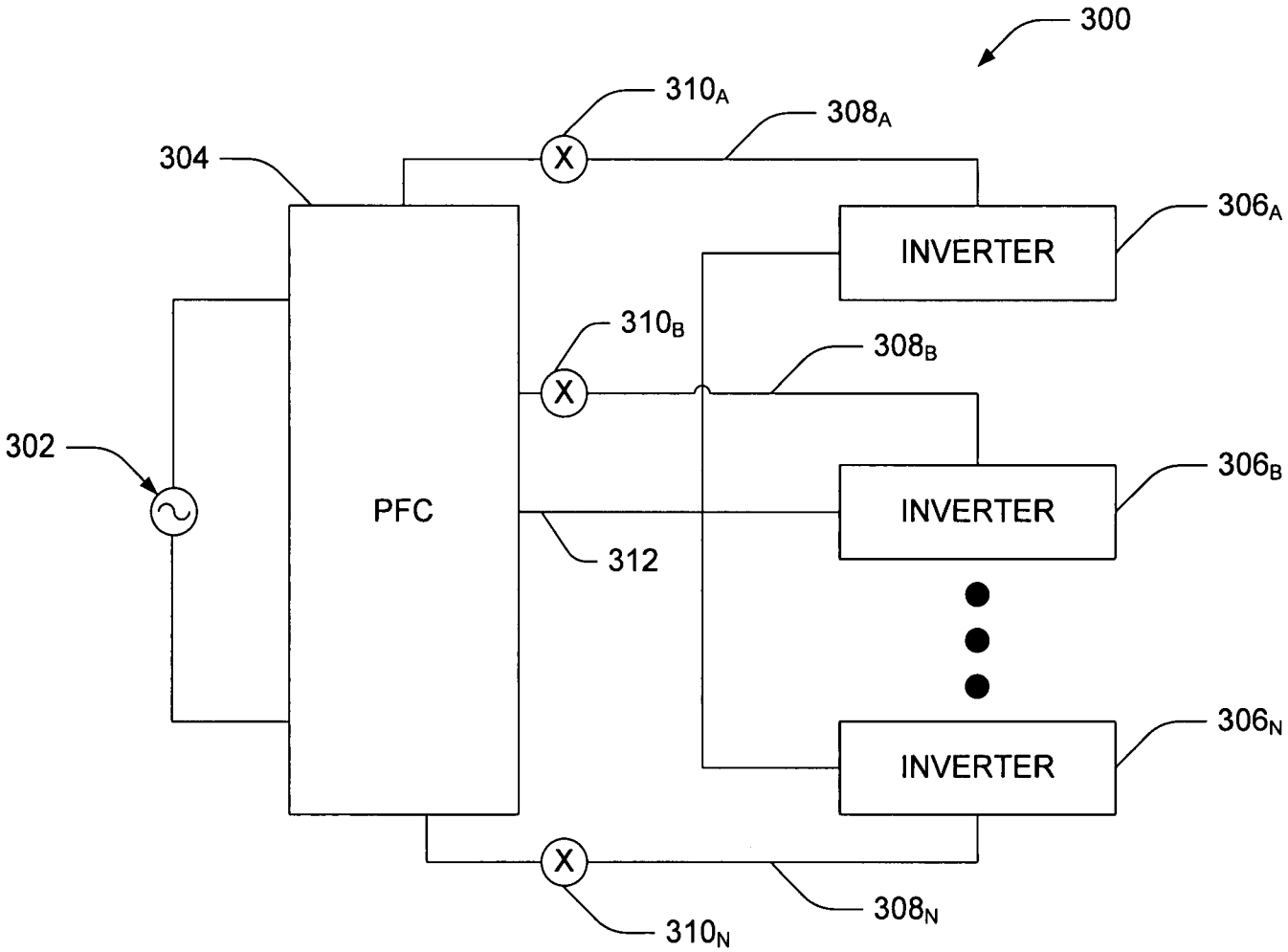
FIG. 3 illustrates a high-level ballast arrangement wherein a plurality of inverters are coupled to a single power factor correction (PFC) circuit in order to reduce manufacturing cost, energy consumption, and device size, in accordance with one or more features described herein.

FIG. 3 illustrates a high-level ballast 300 arrangement wherein a plurality of inverters are coupled to a single power factor correction (PFC) circuit in order to reduce manufacturing cost, energy consumption, and device size, in accordance with one or more features described herein. Ballast 300 comprises a voltage source 302 that is operatively coupled to the PFC circuit 304, which in turn is operatively associated with a plurality of inverter circuits $\mathbf{306}_A$-$\mathbf{306}_N$ (collectively referred to as inverters 306), where N is an integer. Inverters 306 are connected to PFC 304 via connection 312, which may represent one or more physical wire connections between PFC 304 and a given inverter 306, such as described above with regard to the single inverter-PFC ballast designs of the preceding figures. Additionally, each inverter 306 is connected to PFC 304 by a respective switching line 308 with a switch 310 (both labeled A-N, where N is an integer, and corresponding to respective inverters $\mathbf{306}_A$-$\mathbf{306}_N$). Each switch 310 may be triggered by a signal from a remote sensor (not shown), such as a motion sensor that senses the presence or absence of an occupant in an area illuminated by one or more lamps (not shown) associated with each inverter 306.

According to an example, PFC circuit 304 may be operatively associated with four inverters 306, each of which may in turn be connected to two lamps. Each switch 310 may receive a signal from an independent source (e.g., a sensor), from a common source, or from some permutation thereof. For instance, switches 310 for two of the inverters 306 may be coupled to a common source or sensor, while switches for the other two of the inverters each have an independent source, for a total of three sources providing switching signals to the four inverters' switches 310. It will be appreciated that other combinations of sensor-to-switch connections are possible, and that the subject features are not limited to the foregoing example.

Upon an indication from a sensor that an occupant is not present in the area illuminated by a given lamp or pair of lamps associated with a particular inverter, it may be desirable to close the switch 310 for that inverter 306 to cause the ballast, and thus the associated lamps to shut down in order to conserve energy. The indication of the absence of an occupant may be an absence of a signal from a motion sensor. For instance, a switch 310 may remain open so long as a signal from a motion sensor associated with the switch is detected, and may close when the signal is no longer detected. Closing of the switch 310 may trigger the events described above with regard to FIG. 1.

Figure 4:
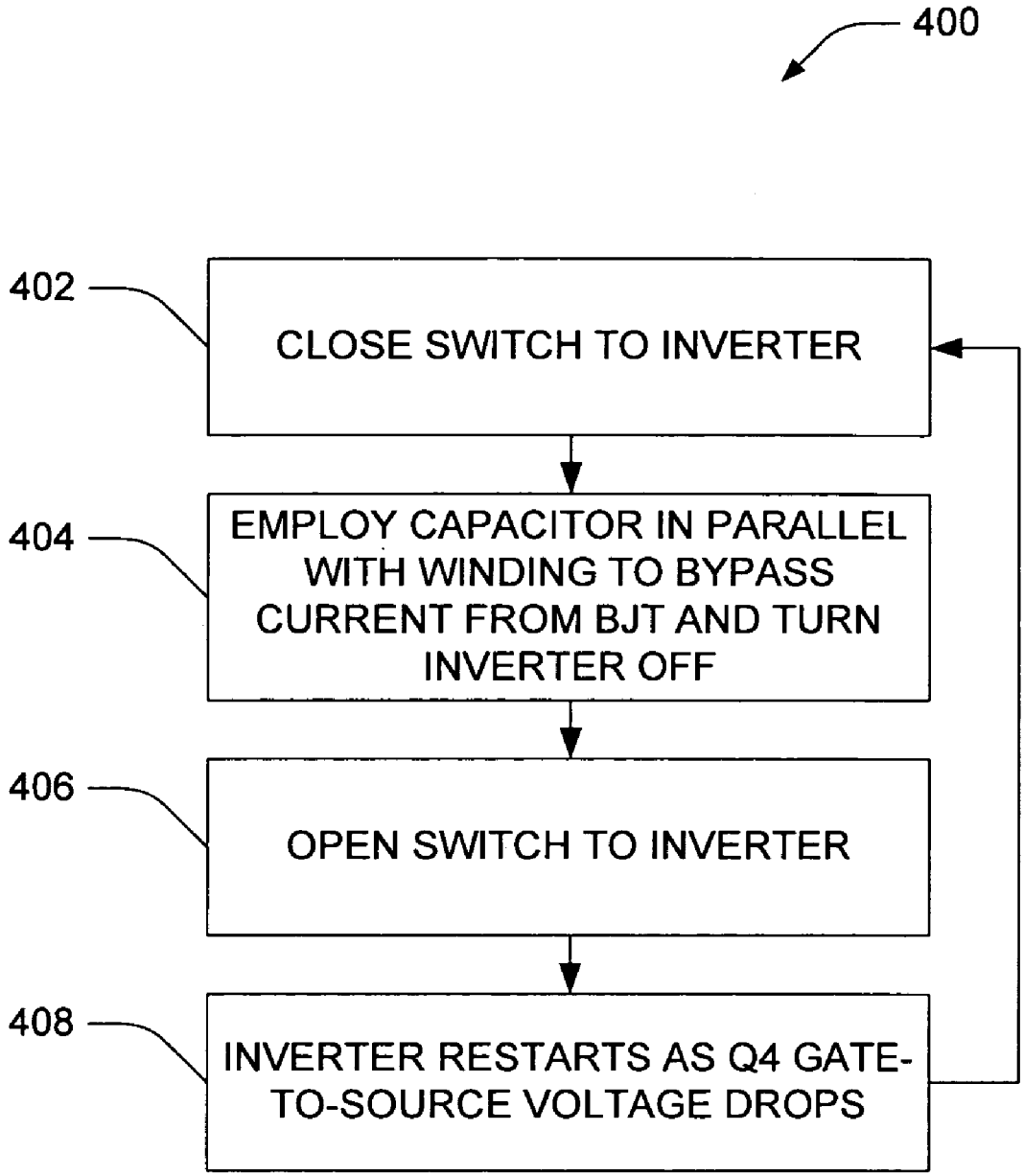
FIG. 4 illustrates a method for performing control line step switching for a lamp ballast, in accordance with various aspects.
Figure 5:
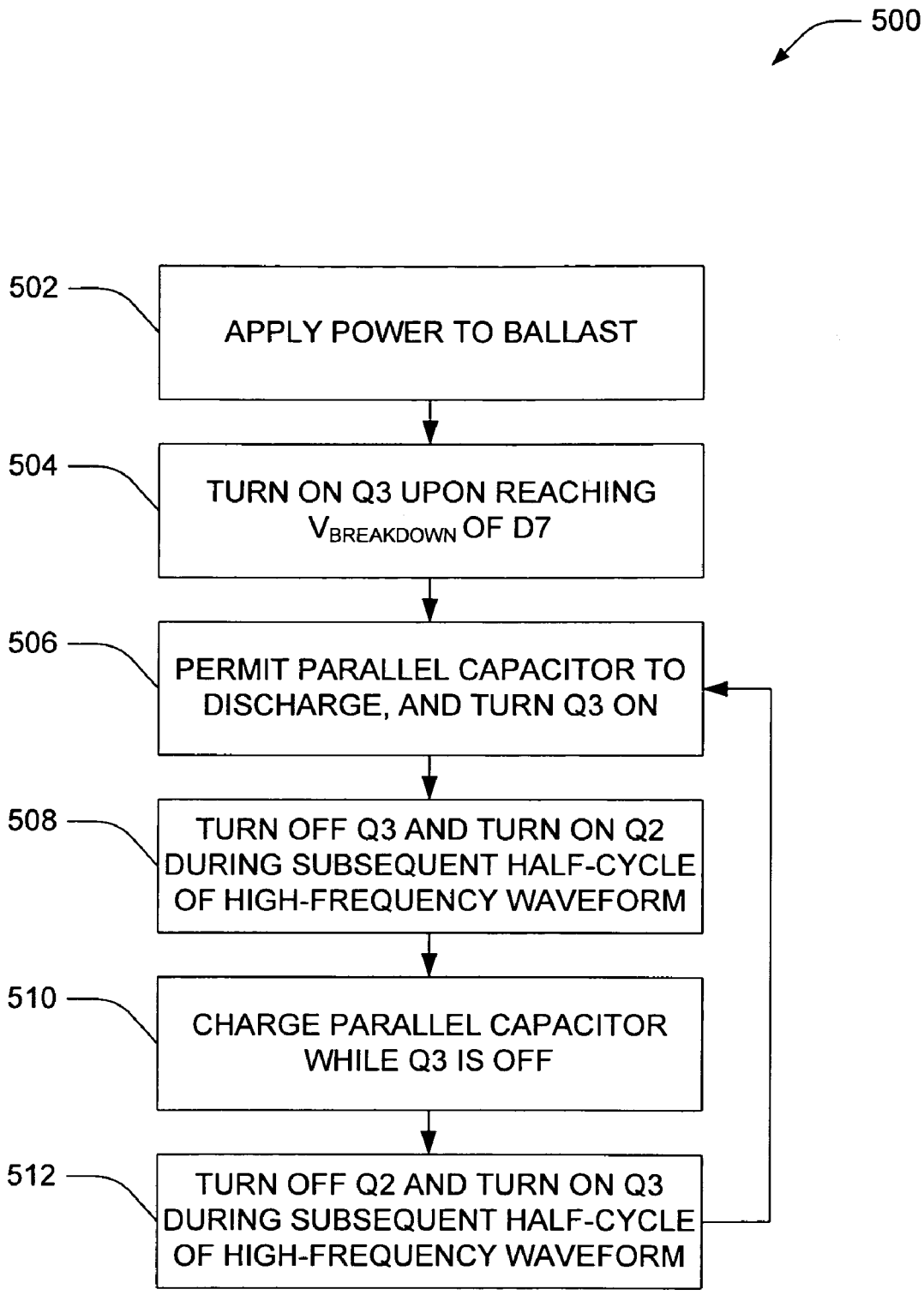
FIG. 5 illustrates a method for employing a capacitor in parallel with a BJT device in an inverter portion of a ballast circuit, such that the parallel capacitor and the BJT permit the inverter to oscillate during an active phase.

With regard to FIGS. 4 and 5, methods are described that facilitate providing a lamp ballast with line control step-level switching, in accordance with one or more of the features presented herein. The methods are represented as flow diagrams depicting a series of acts. However, it will be appreciated that, in accordance with various aspects of the described innovation, one or more acts may occur in an order different than the depicted order, as well as concurrently with one or more other acts. Moreover, it is to be understood that a given method may comprise fewer than all depicted acts, in accordance with some aspects.

FIG. 4 illustrates a method 400 for performing control line step switching for a lamp ballast, in accordance with various aspects. At 402, a switch may be closed in a control signal line that connects a power-factor control (PFC) portion of a ballast to an inverter portion of the ballast. Closing of the switch may be designed to occur upon the occurrence of a predefined event. According to one or more features, the predefined event may be the cessation of a signal from a remote sensor, such that when a condition that causes the remote sensor signal ceases to be present, the remote sensor signal ceases, causing the switch to close. According to a more specific example, the remote sensor may be a motion sensor that detects the presence of an occupant in a space illuminated by a lamp associated with the inverter. In this example, as long as the occupant is present, the motion sensor will relay the signal and the control line switch may remain open. When the occupant leaves the space monitored by the motion sensor, the signal will cease and the switch may close.

It will be appreciated that the various examples and/or features described herein may employ reverse logic as well. For instance, a simple logic inverter may be placed between the remote sensor and the switch, such that the detection of an occupant may be perceived by the switch as an absence of a signal, a "low" signal (e.g., a zero-bit in binary), or the like, and the departure of the occupant from the monitored space be perceived by the switch as a "high" signal (e.g., and inverted low signal in this example). "Low" and "high" as used herein may relate to binary 0s and 1s, respectively, and may additionally or alternatively describe voltage and/or current amplitudes at which a respective signal is relayed form the sensor to the switch.

At 404, the closing of the switch causes a voltage to be applied to a gate-to-source portion of a MOSFET device connected between the switching line and the inverter, which places a capacitor in parallel with a base drive winding for a base junction of a BJT in the inverter circuit, such as is described above with regard to FIG. 1. The capacitor may draw current away from the base drive winding, which in turn causes the inverter to shut down (e.g., inverter oscillation stops). At 406, the switch may be opened again (e.g., due to a detected presence of an occupant, according to the above example). The opening of the switch causes the gate-to-source voltage at the MOSFET to drop, causing the inverter to restart, at 408.

FIG. 5 illustrates a method 500 for employing a capacitor in parallel with a BJT device in an inverter portion of a ballast circuit, such that the parallel capacitor and the BJT permit the inverter to oscillate during an active phase. At 502, power may be applied to a lamp ballast circuit, which may comprise a power factor correction portion and an inverter portion. The inverter may be connected to a switching line that permits the inverter to be shut down upon closing of a switch in the switching line, as described above. When the inverter is on, the parallel capacitor may be permitted to charge until a breakdown voltage for a diac between the parallel capacitor and the BJT is reached, at which point the diac will pass current to the BJT and permit it to operate, at 504. The BJT may be, for example, component Q3 described above with regard to FIG. 1.

At 506, the parallel capacitor may be permitted to discharge while the Q3 BJT is on, which may be a period associated with a first half-cycle of a high-frequency waveform reaching Q3. At the end of the first half-cycle, Q3 may be turned off and a second BJT, such as component Q2 described above, may be turned on for the duration of the second half-cycle of the waveform, at 508. At 510, during the second half-cycle, the parallel capacitor may be permitted to charge by resistor R4. At 512, at the beginning of a subsequent first half-cycle (e.g., of a next period of the waveform), Q2 may be turned off and Q3 may be turned on again, at which point the parallel capacitor begins to discharge by D6. The method may then revert to 506 for further iteration and oscillation of the inverter portion of the ballast. In this manner, the inverter portion of the circuit may be maintained in an on state until a switch in a switching line is closed to turn the inverter off.

In accordance with one or more aspects, examples of values that may be associated with the various components are presented below. However, it is to be understood that the following values are presented for illustrative purposes only, and that the subject components are not limited to such values, but rather may comprise any suitable values to achieve the aforementioned goals and to provide the functionality described herein.

The components of FIG. 1 may comprise the following values according to one or more examples:

| Reference Character | Value/Type |
|---|---|
| C1 | 0.1 uF |
| C2 | 22 uF |
| C3 | 22 uF |
| C4 | 1.5 nF |
| C5 | .22 uF |
| C6 | 3.3 nF |
| C7 | 22 nF |
| D1 | 1N4007 |
| D2 | 1N4007 |
| D3 | 1N4007 |
| D4 | 1N4007 |
| D5 | SR1M |
| D6 | SR1M |
| D7 | 32V DIAC |
| D8 | 7.5V |
| D9 | SR1M |
| L1 | 500 uH |
| L2 | 2 mH |
| L3 | 2 mH |
| MC | PIC10F222 |
| Q1 | SPD07N60C |
| Q2 | BUL742C |
| Q3 | BUL742C |
| Q4 | SN7002N |
| R1 | 1 M |
| R2 | 45 |
| R3 | 45 |
| R4 | 400 K |
| R5 | 22 K |
| T1 | 400 uH |
| Vac | 120V~277V |

The components of FIG. 2 may comprise the following values, according to one or more examples:

| Reference Character | Value/Type |
|---|---|
| C1 | 0.1 uF |
| C2 | 22 uF |
| C3 | 22 uF |
| C4 | 1.5 nF |
| C5 | .22 uF |
| C6 | 3.3 nF |
| C7 | 22 nF |
| D1 | 1N4007 |
| D2 | 1N4007 |
| D3 | 1N4007 |
| D4 | 1N4007 |
| D5 | SR1M |
| D6 | SR1M |
| D7 | 32V DIAC |
| D9 | 7.5V |
| L1 | 500 uH |
| L2 | 2 mH |
| L3 | 2 mH |
| MC | PIC10F222 |
| Q1 | SPD07N60C |
| Q2 | BUL742C |
| Q3 | BUL742C |
| Q4 | SN7002N |
| R1 | 1 M |
| R2 | 45 |
| R3 | 45 |

-continued

| Reference Character | Value/Type |
|---|---|
| T1 | 400 uH |
| Vac | 120V~277V |

The above concepts have been described with reference to various aspects. Obviously, modifications and alterations will occur to others upon reading and understanding the preceding detailed description. It is intended that the concepts be construed as including all such modifications and alterations.

What is claimed is:

1. A system that facilitates automated shutdown and restart of a ballast circuit for a lamp, comprising:

a capacitor positioned in a parallel orientation to a base drive winding for a first transistor in an inverter circuit;

a control line coupled to a voltage source that supplies a voltage to the ballast; and a switch in the control line that is manipulated to concurrently disable inverter oscillation and supply voltage to a trigger circuit coupled to the inverter.

2. The system of claim 1, wherein the lamp is a T5 discharge lamp.

3. The system of claim 1, wherein the switch is coupled to a motion sensor that monitors an area illuminated by the lamp.

4. The system of claim 3, wherein the switch is closed when the motion sensor does not detect the presence of an occupant in the monitored area.

5. The system of claim 1, wherein a second transistor in the trigger circuit experiences a high gate-to-source voltage when the switch is closed.

6. The system of claim 5, wherein the first transistor is a bipolar junction transistor (BJT) and the second transistor is a metal-oxide semiconductor field effect transistor (MOSFET).

7. The system of claim 5, wherein the high gate-to-source voltage condition of the second transistor causes the capacitor to bypass current through the base drive winding away from the base of the first transistor.

8. The system of claim 6, wherein the inverter circuit returns to an active oscillating state and the gate-to-source voltage at the second transistor drops when the switch is opened.

9. The system of claim 1, wherein the inverter is a current-fed inverter.

10. A method of automatically shutting down and restarting a ballast circuit for a lamp, comprising:

employing a capacitor in parallel with a base drive winding for a bipolar junction transistor (BJT) in an inverter circuit;

employing a control line with a switch from a voltage source to a trigger circuit coupled to the inverter circuit; and selectively closing the switch to supply a voltage to the trigger circuit and shut down the inverter circuit.

11. The method of claim 10, further comprising maintaining the switch in an open state when an occupant is detected in an area illuminated by the lamp.

12. The method of claim 10, further comprising closing the switch when no occupant is present in an area illuminated by the lamp.

13. The method of claim 12, wherein closing the switch causes an increase in a gate-to-source voltage at a metal-oxide semiconductor field effect transistor (MOSFET) in the trigger circuit.

14. The method of claim 13, wherein the gate to source voltage at the trigger circuit transistor causes the capacitor to draw current from the base drive winding and away from a base of the BJT.

15. The method of claim 10, further comprising connecting the control line to a neutral terminal of the voltage source.

16. The method of claim 10, further comprising connecting the control line to a current-carrying terminal of the voltage source.

17. The method of claim 10, wherein the inverter circuit is in an oscillating state when the switch is open.

18. The method of claim 10, wherein the lamp is a T5 discharge lamp.

19. A system that facilitates selectively shutting down and restarting an inverter in a ballast circuit for a lamp, comprising:

means for providing a control signal to a trigger circuit coupled to an inverter in the ballast circuit;

means for placing a capacitor in parallel with a base drive winding of a transistor in the inverter to shut down the inverter when a switch in the control signal line is closed; and means for placing the inverter in an oscillatory state when the switch is open.

20. The system of claim 19, wherein the lamp is a T5 discharge lamp.

* * * * *